350-359 SR
3/13/84 XR 4,436,213

United States Patent [19]
Paul, Jr. et al.
[11] 4,436,213
[45] Mar. 13, 1984

[54] CONTAINER HAVING TAMPER EVIDENT SEAL AND IMAGED POLYMER FILM USEFUL AS SUCH A SEAL

[75] Inventors: Fred R. Paul, Jr., Chisago; James S. Mrozinski, Oakdale, both of Minn.

[73] Assignee: Minnesota Mining and Manufacturing Co., St. Paul, Minn.

[21] Appl. No.: 439,638

[22] Filed: Nov. 5, 1982

[51] Int. Cl.[3] ..... B65D 51/00
[52] U.S. Cl. ..... 215/365; 40/310; 215/230; 220/377; 350/359
[58] Field of Search ..... 215/230, 365, 200; 220/214, 359, 377; 40/310, 311, 603; 350/359

[56] References Cited

U.S. PATENT DOCUMENTS

| | | | |
|---|---|---|---|
| 3,817,417 | 6/1974 | Edwards | 215/232 |
| 3,896,965 | 7/1975 | Cornell | 220/359 |
| 4,206,980 | 6/1980 | Volgren | 350/359 |

*Primary Examiner*—Donald F. Norton
*Attorney, Agent, or Firm*—Donald M. Sell; James A. Smith; Richard Francis

[57] ABSTRACT

There is provided a tamper evident container seal comprising a normally transparent polymer film which can be rendered translucent by stretching and transparent by relaxing. There is also provided a polymer film useful as a seal of the same type of film which bears an image which is not readily visible when the film is relaxed, but becomes readily visible when the film is stretched.

11 Claims, 3 Drawing Figures

CONTAINER HAVING TAMPER EVIDENT SEAL AND IMAGED POLYMER FILM USEFUL AS SUCH A SEAL

DESCRIPTION

1. Technical Field

The invention relates to a tamper evident container seal comprising a normally transparent polymer film which can be rendered translucent by stretching and transparent by relaxing. The invention further relates to a polymer film useful as a seal of the same type of film which bears an image which is not readily visible when the film is relaxed, but becomes readily visible when the film is stretched.

2. Background Art

Tampering with the contents of various containers by careless or malicious individuals is becoming more prevalent. For example, malicious individuals have been known to open bottles of non-prescription capsules and replace part or all of the non-prescription formulation in the capsule with a hazardous substance which could injure or kill a person who ingests the capsule.

Various means for guarding against tampering or revealing when tampering has occurred are available, but they are not entirely satisfactory for reasons which will be explained. For example, some non-prescription drugs, e.g., capsules or pills, are individually sealed in packets or pouches which must be torn open to remove the contents. Such a method of packaging is inconvenient because of the required duplication of effort each time the user wishes to remove a pill or capsule.

Container seals have been known and used with some success for a considerable period of time. A seal is a closure that must be broken in order to open the container, thus revealing tampering, if it is broken before the ultimate user opens the container. The simplest form of a container seal is a sheet formed of paper, polymeric film or aluminum foil which is adhered or heat sealed completely over the opening into the container. Polymeric film seals are popular because they may be transparent, permitting viewing inside the container, and they may be easily heat sealed to the mouth of a container such as a bottle typically without requiring additional adhesive materials. Polymeric seals are not entirely foolproof, however, because they can be cut from the mouth of a container such as a bottle adjacent the seal and repositioned by moderate stretching, because a polymeric film will yield, and again heat sealed to produce a result which does not visibly differ from the original sealing.

U.S. Pat. No. 3,896,965, assigned to the assignee of the present application, discloses a tamper indicating closure tape which permanently changes color with flexing, thereby indicating when the closure has been tampered with. Such a closure uses a binder layer containing capsules containing a colored substance.

Disclosure of Invention

The present invention provides a container having walls defining a cavity and an opening into the cavity covered by a seal comprising a normally transparent polymer film which can be repeatedly rendered translucent by stretching and transparent by releasing. The invention also provides a normally transparent polymer film of this type which bears an image which is not readily visible when the film is relaxed but becomes readily visible when it is stretched.

Prefered films for use as seals to the present invention comprise a quenched sheet comprising up to 40–85 percent by weight of a thermoplastic polymer having at least 5 percent crystallinity and 15 to 60 parts by weight of a compound in which said polymer will dissolve or form a solution at the melting temperature of the polymer but from which the polymer will separate on cooling to a temperature below the melting temperature of the polymer.

Films which may be utilized as container seals according to the present invention are preferably prepared according to Krueger (U.S. Pat. No. 4,206,980), assigned to the assignee of the present application, the disclosure of which patent is incorporated herein by reference.

The film is such that it is initially transparent, permitting a person to see inside the container to examine its contents. A simple test for determining whether or not the container contents have been tampered with is accomplished by pressing on the seal, thereby causing it to stretch, thus rendering it translucent in the stretched area. If the film is initially transparent and may be rendered translucent by such pressing, the user can be assured that the original seal is still in place.

If someone attempted to tamper with the contents of the container and for this purpose cut the seal from the container opening just inside the point of sealing, and stretched the film to replace it, such stretching would render the film partially or entirely permanently translucent, clearly indicating that tampering has occurred.

It is further possible to image the film with indicia which is not readily visible when the film is relaxed but which would become visible when the film is stretched. Such imaging may be accomplished by modifying the normally transparent film in image-defining areas to fuse the film and thereby destroy its ability to be rendered translucent on stretching. Stretching would of course render the remainder of the film translucent thus exposing the fused image as a transparent or semi-transparent image in a translucent background making the image easily visible.

DESCRIPTION OF THE DRAWING

A further understanding of the invention may be had by referring to the accompanying drawing in which like numbers refer to like parts in several views and in which.

BEST MODE FOR CARRYING OUT THE INVENTION

Figure 2:
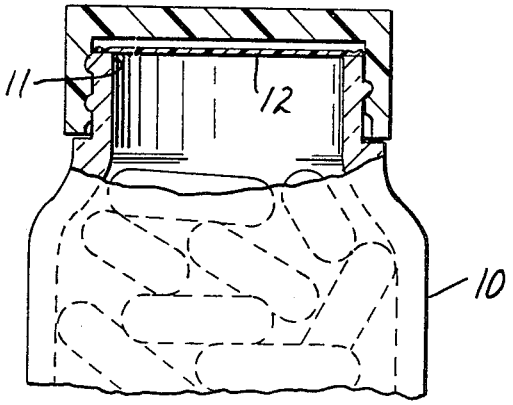
FIG. 2 is a cross-sectional view of the top portion of the bottle shown in FIG. 1 taken along the section line 2—2, except having a cover in place.
Figure 1:
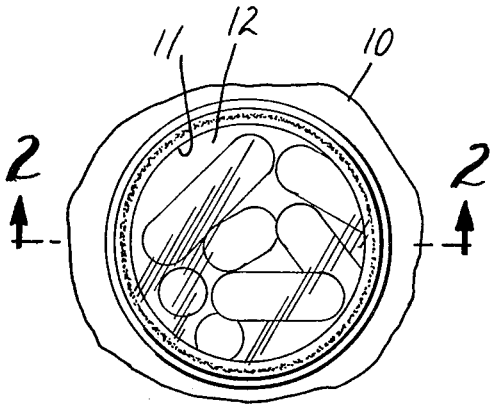
FIG. 1 is a top plan view of an uncovered bottle sealed in accordance with the invention.
Figure 3:
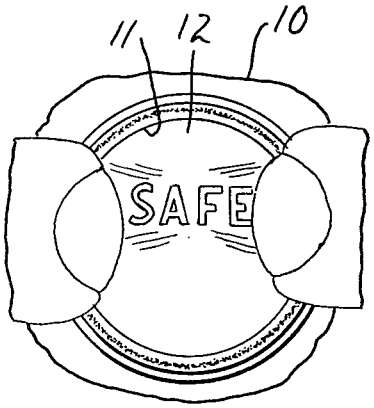
FIG. 3 is a top plan view of the sealed bottle of FIG. 1, showing pressure being applied to the seal by application of finger pressure revealing the message "SAFE".

Referring to FIGS. 1–3 of the drawing, there is shown bottle 10 having mouth 11 which is covered by seal 12 in accordance with the present invention.

FIG. 3 shows pressure being applied to imagebearing seal to reveal the word "SAFE" as the film seal is stretched by finger pressure.

The sealed container in accordance with the present invention may be prepared by utilizing conventional sealing methods to permenantly afix the polymer film over the opening into the container. Such conventional methods include conventional heat sealing methods, adhesive bonding, and solvent or sonic welding. Heat sealing polypropylene film is easily accomplished at heat sealing temperatures of about 275° F. (57° C.). Polyethylene films may be heat sealed at approximately 250° F. (50° C.).

Particularly useful polypropylene film examples which may be utilized to prepare the seals in accordance with the present invention are disclosed in the Example Nos. 1–3, 6 and 7 of aforementioned Krueger et al U.S. Pat. No. 4,206,980. Example 4 of the patent discloses a particularly useful polyethylene film.

Preferred films of the Krueger et al patent include those made of polyolefin or polyolefin copolymer. Useful films may be formed of polypropylene and polyethylene/propylene copolymer with mineral oil, polyethylene with mineral oil or mineral spirits, or polyethylene terephthalate with diethyl phthalate.

Other polymer films may also be used. For example, a commercially available microporous film sold under the trade designation "Celgard", e.g. "Celgard" 2400 provides a reversible transparent-translucent film if it is first wet with mineral oil to fill the micropores. Other microporous films may also be useful if modified in the same manner.

The polymer films may easily be imaged by use of a conventional thermographic copying machine, such as a "Thermofax" copying machine commercially available from the assignee of the present application, by passing a reversibly transparent film through the thermographic copying machine together with an image-bearing sheet such a sheet of paper which contains the appropriate indicia be transfered to the polymer sheet. Heating in the thermographic copying machine causes thermographically-receptive image patterns on the paper to heat and fuse image-wise portions of the reversibly transparent film to destroy the ability of the sheet in such areas to be rendered translucent on stretching.

The films described above are normally transparent and will be rendered translucent on stretching as little as one percent and prefereably no more than 5 percent. Stretching beyond about 5 percent renders the film permanently translucent, thereby providing a means of indicating that the container contents have been tampered with.

The container may be any conventional container such as a bottle, vial, box, can, or the like. The reversably transparent film typically is cut to overlap the opening of the container and appropriate sealing or adhering means applied to permanently fasten the seal over the opening of the container.

Various modifications of the invention as described may be made without departing from the scope of the claims. For example, the films of the Krueger et al patent may be colored by adding minute quantities of dye to the additive compound. Useful dyes for addition to mineral oil or other organic additives include those sold under the trade designation "Maerolex" yellow 3G, "Reisen" red and "Violet" from the Mobay Chemical Co. Quantities of dye on the order of about ¼% by weight have been found to be sufficient.

We claim:

1. A container having walls defining a cavity and an opening into said cavity covered by a tamper evident seal comprising a normally transparent polymer film which can be repeatedly rendered temporarily translucent by stretching and transparent by relaxing.

2. The container of claim 1 wherein said normally transparent film comprises a quenched sheet comprising 40 to 85 parts by weight of a thermoplastic polymer having at least 5 percent crystallinity and 15 to 60 parts by weight of a compound in which said polymer will dissolve or form a solution at the melting temperature of said polymer but from which said polymer will separate on cooling to a temperature below the melting temperature of said polymer.

3. The container of claim 2 wherein said polymer is a polyolefin or a polyolefin copolymer.

4. The container of claim 2 wherein said polymer is polypropylene and said compound is mineral oil.

5. The container of claim 2 wherein said polymer is polyethylene and said compound is mineral oil or mineral spirits.

6. The container of claim 2 wherein said polymer is polyethylene/polypropylene copolymer and said compound is mineral oil.

7. The container of claim 2 wherein said polymer is polyethylene terephthalate and said compound is diethyl phthalate.

8. The container of claim 1 wherein said normally transparent film comprises a quenched sheet comprising 40 to 85 parts by weight of a polyethylene having at least 5 percent crystallinity and 15 to 60 parts by weight of mineral oil.

9. The container of claim 1 wherein said normally transparent film bears an image which is not readily visible when said film is relaxed but becomes readily visible when said film is stretched.

10. The container of claim 1 wherein said walls define a bottle and said opening is the mouth of said bottle.

11. A normally transparent polymer film which can be repeatedly rendered temporarily translucent by stretching and transparent by relaxing bearing an image which is not readily visible when said film is relaxed but becomes readily visible when said film is stretched.

* * * * *